US005713286A

United States Patent [19]

Zorn

[11] Patent Number: 5,713,286

[45] Date of Patent: Feb. 3, 1998

[54] METHOD FOR REGULATING DAMPENING AGENT

[75] Inventor: Herbert Josef Zorn, Birkenfeld, Germany

[73] Assignee: Koenig & Bauer-Albert Aktiengesellschaft, Wurzburg, Germany

[21] Appl. No.: 650,789

[22] Filed: May 20, 1996

[30] Foreign Application Priority Data

May 20, 1995 [DE] Germany ..... 195-18-660

[51] Int. Cl.[6] ..... B41F 7/24

[52] U.S. Cl. ..... 101/450.1; 101/138; 101/147

[58] Field of Search ..... 101/450.1, 147, 101/148, 136–140, 141, 143, 451, 452, 349, 350, 363, 365, DIG. 45, DIG. 47, 483–485; 356/414, 446, 448, 429, 431, 445; 250/559.01, 559.04, 559.06

[56] References Cited

U.S. PATENT DOCUMENTS 5,050,994 9/1991 Kipphan et al. .
5,258,925 11/1993 Maier et al. .
5,341,734 8/1994 Jeschke et al. ..... 101/148
5,520,113 5/1996 Joss et al. .

FOREIGN PATENT DOCUMENTS 0 388 697 9/1990 European Pat. Off. .
0 357 987 4/1995 European Pat. Off. .
2 346 016 3/1974 Germany .
38 30 732 3/1990 Germany .
40 05 558 9/1991 Germany .
40 28 083 3/1992 Germany .
42 38 557 5/1994 Germany .
43 28 864 3/1995 Germany .

*Primary Examiner*—J. Reed Fisher
*Attorney, Agent, or Firm*—Jones, Tullar & Cooper, P.C.

[57] ABSTRACT

The amount of a dampening agent applied to a printing unit is regulated by sensing the light reflected from several unprinted areas of a web that has passed through the printing unit. The reflectance of a center blank strip is used as a reference and the reflectance of adjacent strips are compared to this reference. Dampening fluid is regulated on the basis of this comparison.

12 Claims, 3 Drawing Sheets

METHOD FOR REGULATING DAMPENING AGENT

FIELD OF THE INVENTION

The present invention is directed generally to a method for regulating or controlling the amount of a dampening agent. More particularly, the present invention is directed to a method for regulating the amount of dampening agent on a printing plate of a web-fed rotary printing press. Most specifically, the present invention is directed to a method for regulating the amount of dampening agent on a printing plate of a web-fed rotary printing press by use of an optoelectrical detector. The detector is located adjacent the web which has been printed. A portion of the web which is not contacted by printing plates is sensed as are areas of the web which are contacted by the plates but which are not printed. The presence of ink in these plate contacted, unprinted web areas is sensed and is utilized to regulate the amount of dampening agent applied to the plates.

DESCRIPTION OF THE PRIOR ART

In the field of web-fed rotary printing, the various printing plates that are used to print the web are supplied with printing ink from an inking unit. A dampening fluid, such as water, is also supplied to the printing plates on the plate cylinder by a dampening unit. The quality of the printed product is affected by the amount of dampening agent supplied to the plate. Too little dampening agent is apt to result in the transfer of ink from print areas of the printing plates to areas of the plate which are not being used for printing. This is called scumming and has an adverse effect on print quality. If too much dampening agent is supplied, the ink quality will be adversely affected and the printed product will not be of acceptable quality. It is thus necessary to regulate or control the amount of dampening agent supplied to a printing plate.

A method for determining a measurement location for detecting an amount of a dampening agent on a printing plate is disclosed in European Patent Publication EP 0 388 697A2. In this method, a measuring head scans the surface of the printing plate and fixes or locates the measurement location in such a way that this measurement location is situated or lies in a zone with the lowest possible mean planar coverage.

A limitation of this prior art method is that the measurement location must be determined or fixed with every change of the printing plates. Thus when the plate cylinders are provided with printing plates having new print images, the measuring head must again scan the surface of the printing plates or fix a new measurement location for each new plate.

In the German Patent Publication DE 43 28 864A1 there is shown a device that is used for detecting the smudging limit during offset printing being done by a printing press. A surface zone, which is ink free, is formed in the printing plate or printing forme outside of the printing area of the plate or forme. This surface zone, which is intended to remain ink free, is monitored by an optical sensor which determines the presence of, or the indication of ink in this zone.

In this prior art device, there is a separate device assigned to each printing plate. These devices are arranged on the plate cylinder and limit the accessibility of the printing unit. In addition, since no defined reference surface has been defined in the printing plate, changes in the reflecting properties of the printing forme or plate, such as may be caused by oxidation of an aluminum printing plate, can lead to false or inaccurate measurements.

Another method that is used to monitor and to regulate the supply of a dampening agent guide in an offset printing press is described in European Patent Publication EP 0 357 987B1. A measurement area is scanned by an optical sensor. This measurement area includes a measurement field with a large planar coverage and, as viewed in the printing direction, an immediately adjacent area which is per se free of ink.

A limitation of this prior art method is that no reference value is provided which will detect changes in the reflection properties of a sheet to be evaluated. It is a significant disadvantage that it is necessary either to print an additional print control element, which reduces the usable surface of the cylinder circumference, or to determine the measurement area on the printing forme each time the printing forme is changed to accomplish a new print order.

It will be seen that a need exists for a method for regulating the supply of a dampening agent which overcomes the limitations of the prior art. The method for regulating dampening agent in accordance with the present invention overcomes these limitations and is a significant improvement over the prior art.

SUMMARY OF THE INVENTION

It is an object of the present invention to provide a method for regulating or controlling the amount of a dampening agent.

Another object of the present invention is to provide a method for regulating the amount of dampening agent on a printing plate of a web-fed rotary printing press.

A further object of the present invention is to provide a method for regulating the amount of dampening agent on a printing plate of a web-fed rotary printing press by using an optoelectrical detector.

Still another object of the present invention is to provide a method for regulating the amount of dampening agent on a printing plate in which the regulation of the dampening agent is accomplished regardless of the subject of the printing plate.

Even yet a further object of the present invention is to provide a method for regulating dampening agent which does not limit the usable printing area of the printing cylinder's circumference by the use of printing control elements.

As will be discussed in detail in the description of the preferred embodiment, which is presented subsequently, the method for regulating dampening agent in accordance with the present invention utilizes a measuring bar that carries a plurality of sensors. These sensors provide a reference signal that is determined by sensing a composite blank or unprinted area in the web. A central portion of this blank strip exists because of the existence of a clamping groove or channel on the plate cylinder. Additional measurements are taken in leading and trailing blank strip portions of the composite blank area that are situated intermediate the central blank channel strip and printed area of the web. An amount of deposited ink in these plate contacted, but not printed leading and trailing blank web areas is compared with the reference values provided from the central, blank, non-plate contacted areas. The amount of dampening agent supplied to the printing plates is controlled based on a comparison of these signals or values.

A primary advantage of the subject invention is that the measurement location for use in determining a scumming limit is fixed in relation to the cylinder and is independent of the subject of the printing plate. All plates have a non-printing edge or border portion and the existence of ink in these areas is sensed and is used to control the supply of dampening agent. Elaborate devices and methods for determining this measurement location are not necessary.

The strip to be evaluated on the web can be evaluated downstream of print units and is therefor freely accessible. A measuring bar can be disposed in a convenient area downstream of the print unit or units generally in an arbitrary location along the path of web guidance. In comparison with prior art devices that utilize measuring heads that scan the printing plate itself, the measuring bar of the present invention is less subjected to soiling and the accessibility of the cylinder is more easily maintained. No print control elements are needed since the evaluation occurs in an image-free strip of the web. This allows the web to be used in the most optimal manner to produce the desired finished printed product. No unusable areas of the web to be printed are created by the present invention which does not require the printing of printed control elements or patterns on the web. All the printable area of the web can be used in the production of printed products.

Any changes in the properties of the web, such as changes in the ink used, in soilage of the web, in reflections and the like, can be compensated for, or accommodated by use of a reference measurement of the web. The existence of even a narrow scum area can be detected by the present process which monitors the entire width of the web and which uses a multiple number of detectors. These scum zones, which are apt to extend in the circumference direction of the plate cylinder typically appear particularly in connection with spray dampening systems if individual spray nozzles fail or become clogged or obstructed. It is possible to compensate for these individual spray nozzle failures and to achieve an even regulation of the amount of dampening fluid over the width of the web by changing the amounts sprayed by the individual spray nozzles.

The method for regulating dampening agent in accordance with the present invention overcomes the limitations of the prior art. It is a substantial advance in the art.

BRIEF DESCRIPTION OF THE DRAWINGS

While the novel features of the method for regulating dampening agent in accordance with the present invention are set forth with particularity in the appended claims, a full and complete understanding of the invention may be had by referring to the detailed description of the preferred embodiment which is set forth subsequently, and as illustrated in the accompanying drawings, in which:

DETAILED DESCRIPTION OF THE PREFERRED EMBODIMENT

Figure 1:
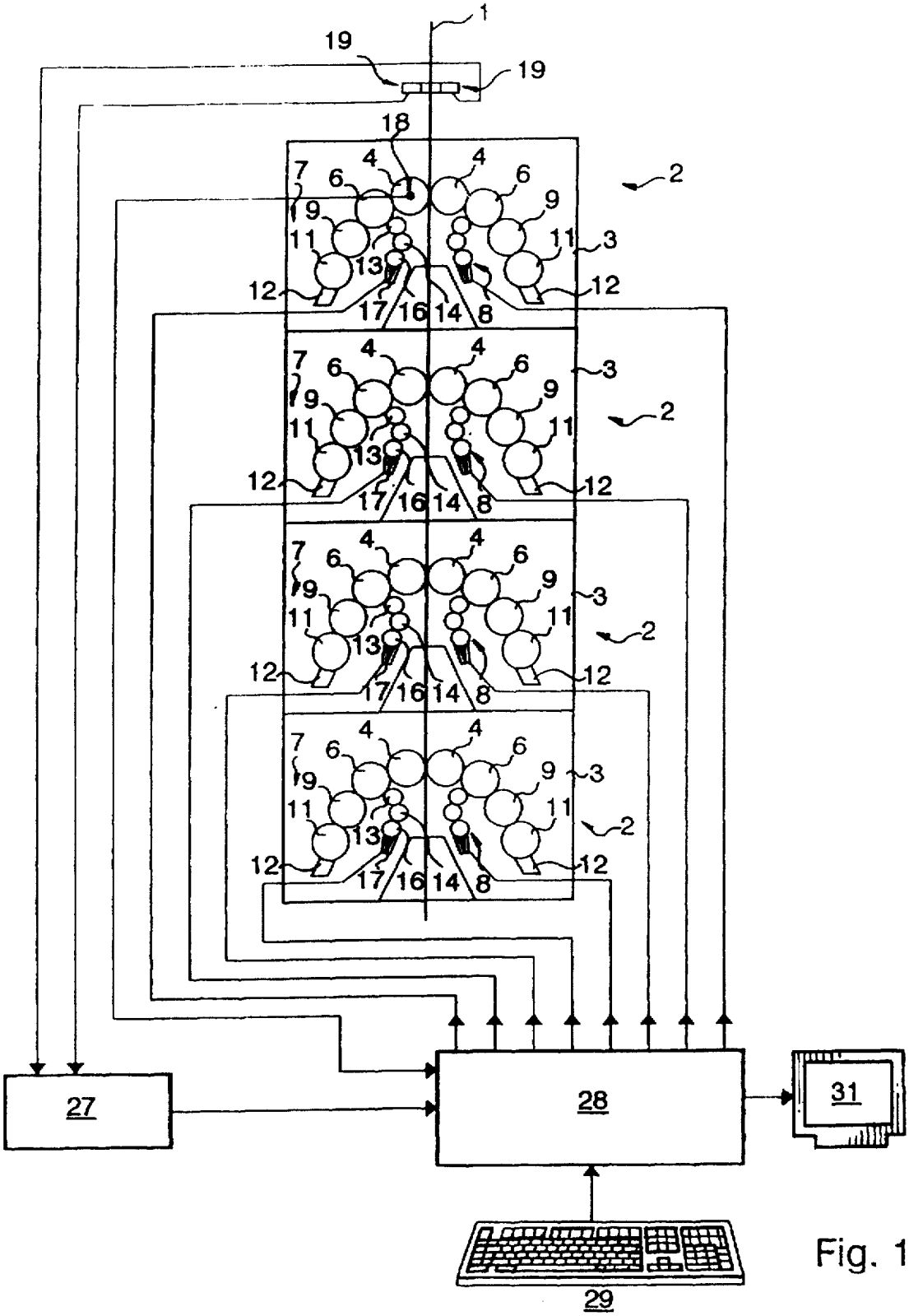
FIG. 1 is a schematic elevation view of a web-fed rotary printing press utilizing the method of regulating dampening agent in accordance with the present invention.

Referring initially to FIG. 1, there may be seen a web 1 which is printed front and back in a web-fed rotary printing press, in particular in a newspaper printing press, by means of print units 2, with, in the illustrated example, there being four print units 2. Each one of these print units 2 is embodied in bridge construction symmetrically about the web 1. Two rubber blanket cylinders 4, two plate cylinders 6 and their associated ink or dampening systems 7 or 8, respectively are seated in side frames of these print units 2. In the present embodiment, the ink systems 7 are embodied as anilox or short ink systems, each one consisting of an ink transfer cylinder 9, a screen cylinder 11 and a doctor device 12. The dampening systems 8 are embodied as spray dampening systems, for example, and essentially consist of the dampening agent transfer cylinders 13, 14, 16 and a spray device cooperating with them. Printing plates are fastened on the plate 17 cylinders 6, and these plates are supplied with a defined amount of dampening agent by means of the dampening systems 8. The amount of dampening agent applied to the printing plates is a function of the frequency of the spraying pulses of the spray device 17, for example. Forme cylinders with other printing formes, such as for example, sleeves are also possible instead of the plate cylinders 6 provided with printing plates.

An angular position encoder 18 such as, for example, a resolver, is coupled with at least one rubber blanket or plate cylinder 4 or 6, as seen in FIG. 1, in order to detect the angular position of the plate or rubber blanket cylinders 6 or 4. One measuring bar 19 is disposed transversely to the web 1 on each of the two sides of the web 1 downstream of the print units 2, viewed in the running direction of the web 1, as may also be seen in FIG. 1. In the arrangement depicted in FIG. 1, the direction of web travel is generally vertically upwardly through the four bridge printing units 2. It will be understood that the direction of travel could be reversed which would require the shifting of the measuring bars 19 so that they would again be located after the printing units 2 in the direction of travel of the web 1.

Figure 2:
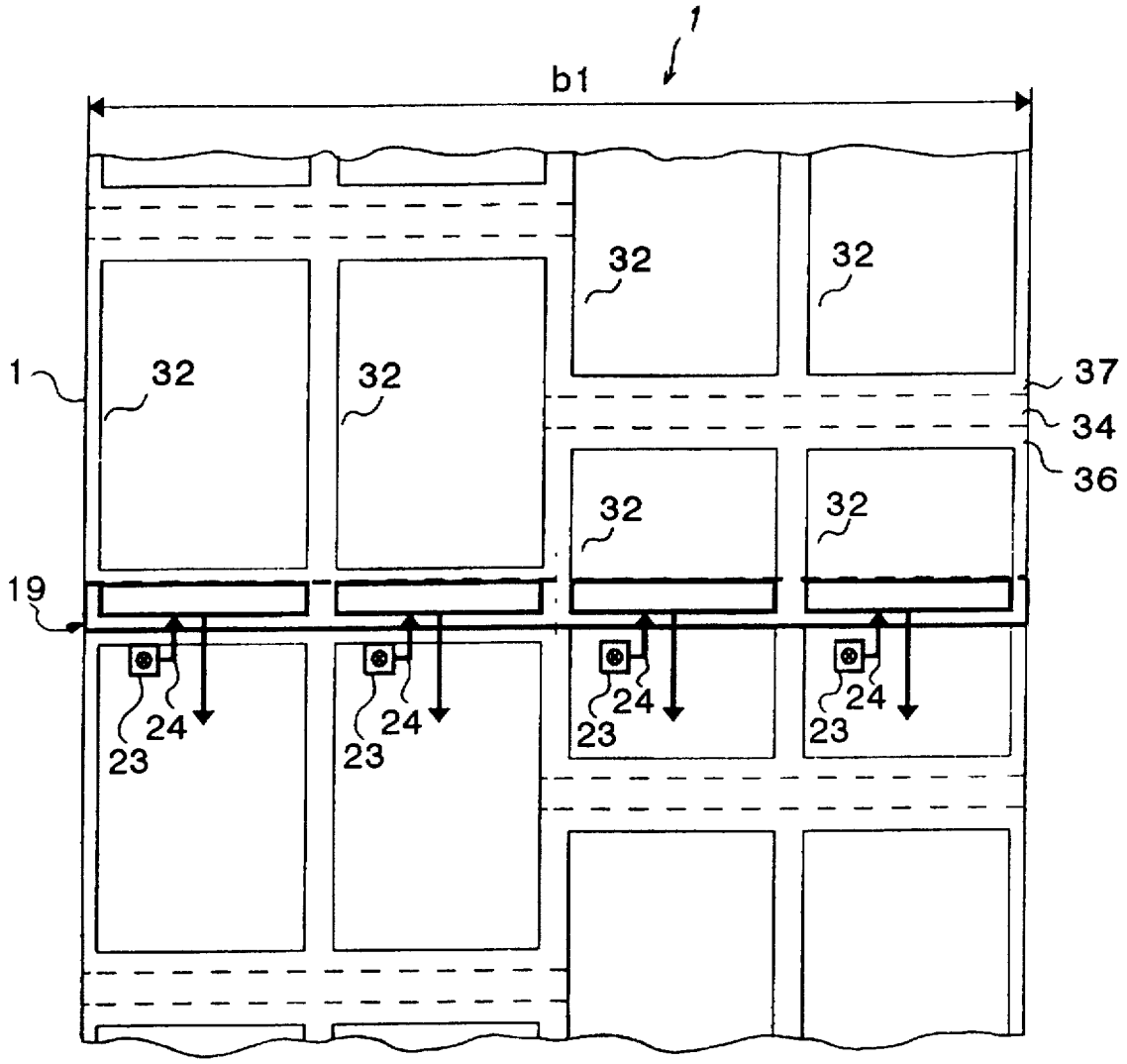
FIG. 2 is a schematic representation of a top view of a printed web and showing the location of a measuring bar in accordance with the present invention.
Figure 3:
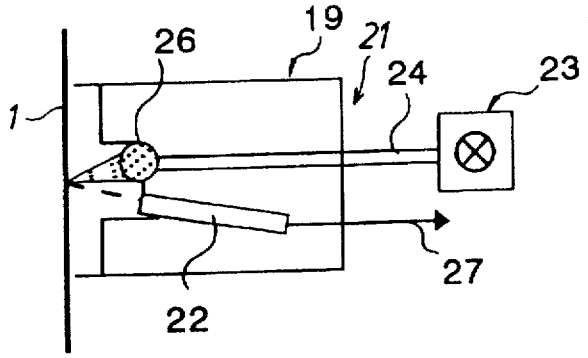
FIG. 3 is an enlarged side elevation view of the web and bar shown in FIG. 2.

Referring now more particularly to FIGS. 2 and 3, each one of a plurality of measuring bars 19 is provided with at least one illumination device 21 and with optoelectrical detectors 22 arranged closely next to each other. These optoelectrical detectors 22 are, in the preferred embodiment, photodiodes. In the present embodiment, the illumination device 21 consists of a light source 23 disposed exteriorly of the measuring bar 19 and which transmits light to a cylinder lens 26 that extends parallel with the measuring bar 19. This light is transmitted to lens 26 by means of a multiple number of optical waveguides 24. This cylinder lens 26 focuses the light emanating from the optical waveguides 24 to form a line of light extending transversely to the web 1. It would also be possible to arrange additional optical waveguides 24 on the measuring bar 19 and to connect them with detectors 22 arranged at any arbitrary location. The illumination device 21 continuously illuminates the web 1, and the detectors 22 receive light reflected by the web 1 at times determined by a trigger signal. In the present embodiment, four such illumination devices 21 and their associated detectors 22 are arranged along the measuring bar 19 in order to cover the entire width b1, for example b1=1270 mm, of the web 1 by measuring techniques almost without gaps. It is also possible to cover only defined selected areas of the web 1 and therefore to dispose illumination devices 21 and detectors 22 only partially across the width b1 of the web 1. It is also possible to assign to each print unit 2 its own measuring bar 19.

Again referring to FIG. 1, all of the detectors 22 are connected with an evaluation circuit 27 which, in turn, is connected with a computer 28. On its input side, the computer 28 is connected with the angular position encoder 18, and on its output side the computer is connected with the dampening systems 8. An input station 29 for the manual input of correction or control data, and a display unit 31 are additionally connected with the computer 28. The computer receives input data from the evaluation circuit 27, the angular position encoder 18 and from the input station 29 and sends control signals to the dampening systems 8.

Figure 4:
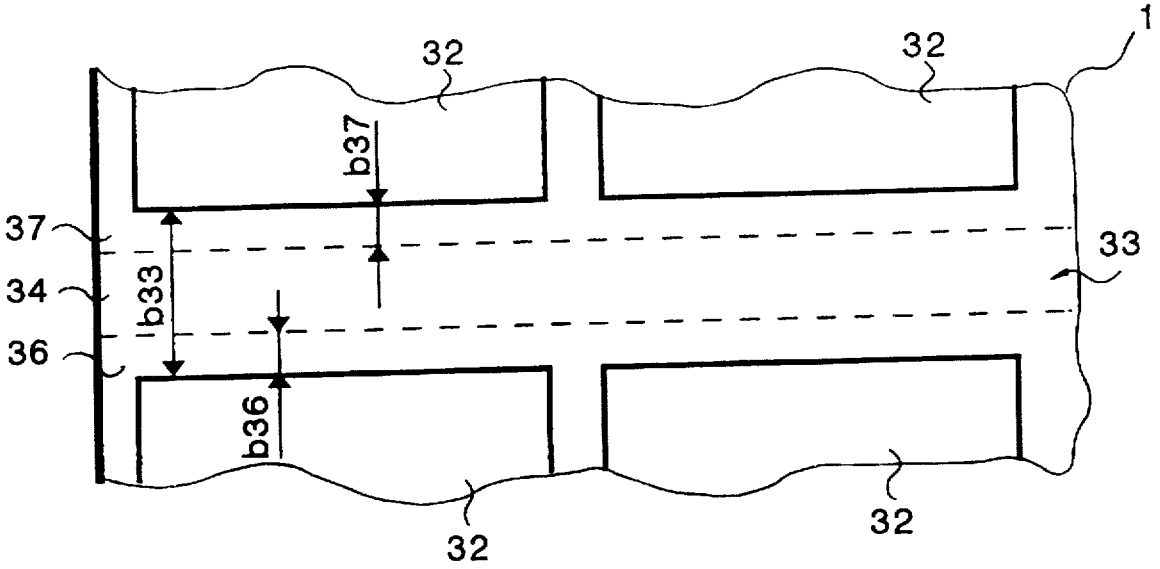
FIG. 4 is an enlarged top plan view of a portion of a printed web and showing the areas of the web being sensed.

Turning now primarily to FIGS. 2 and 4, it may be seen that the web 1 is transversely printed by the printing unit 2 with, for example, four print areas 32, i.e. with four image or print fields. In the running direction of the web 1, there is one composite blank strip 33 extending transversely to the web 1 and parallel with the cylinders 4, 6 between each two successive print areas 32. This composite blank strip 33 of a width b33, for example b33=35 mm, is composed of a first, center strip 34, which is created as a result of the existence of a channel or groove on the surfaces of the respective plate cylinder 6, and of leading and trailing blank strips 36, 37 adjoining both sides of the center or channel strip 34. A leading blank strip 36 of a width b36, for example b36=9 mm, is located in the area of the start of the print, while the other or trailing blank strip 37 of a width b37, for example b37=9 mm, is located in the area of the end of the print of a printing plate fastened on the plate cylinder 6. The channel or groove of the plate cylinder 6 and the print areas 32 therefore delimit the respective leading and trailing print-free narrow strips 36, 37. These leading and trailing blank strips 36 and 37 lie in the area of a product formed from the web 1, for example a folded newspaper, in which a fold is formed or in which gripper points are received. These strips 36 and 37 can be visible in the finished product and are present in each product, for example as edges. The channel or groove of the plate cylinder 6 is conventionally utilized to connect the flexible printing plate or plates to the surface of the plate cylinder. A similar groove or channel frequently exists on the surface of the cooperating blanket cylinder 4. In the area of each such printing cylinder channel or groove there is no printing plate and hence there will be formed the center or channel or groove unprinted strip 34 in the web 1 between subsequent print areas 32. Also since each printing plate secured to the cylinder 6 has a leading or start area, as well as a trailing or end area which is not used for printing since it is not possible to completely cover each plate with printing surfaces, the leading blank strip 36 and the trailing blank strip 37 will adjoin the center, channel or groove blank strip 34 and these three strips 34, 36 and 37 will combine to form the composite blank strip 33.

Referring now primarily to FIG. 1, the method for regulating the amount of dampening agent to the plate cylinders 6 of the printing units 2, to accomplish the most expeditious printing of the web 1 in accordance with the present invention will now be discussed in detail. The angular positions of the cylinders 4 and 6 are supplied to the computer 28 by means of the angular position encoder 18 and in this way a reference is established for the location of the composite blank strip 33 between the successive print areas 32. The computer 28 determines the time for a first trigger signal in this manner and triggers a measurement taken in the center blank strip 34 which is formed because of the existence of the channel or groove in the plate cylinder. This center blank strip 34 is always free of ink, since no ink can be transferred here because of the plate channel or groove. This center strip 34 can therefore be employed for the determination of a reference measurement. This reference measurement allows assured measuring results even if ink tolerances of a base ink or soiling of the web 1 occur. This reference measurement can be performed during each cylinder revolution or at defined intervals. Following the reference measurement, a second measurement is performed by means of a second trigger signal in one of the two leading or trailing blank strips 36 or 37, preferably in the leading strip 36 located at the start of the print. It is also possible to measure both leading and trailing blank strips 36, 37 in succession. The running web 1 is continuously illuminated by the illumination device 21 for measuring, and the light reflected by the strips 34, 36, 37 is detected by the detectors 22 at the times fixed by the trigger signals. This reflected light is split into individual spectral ranges associated with defined ink colors used. This can be done by means of filters, wherein a filter with a detector 22 is associated with each spectral range typical for an ink color. An ink color is then assigned to these spectral ranges, by means of which the corresponding print unit 2 which is to be adjusted is fixed.

The measurement of the leading blank strip 36 in front of the print area 32 is compared with the reference measurement in the computer 28. If traces of one or several ink colors are present in the leading strip 36 in front of the print area 32, the amount of dampening agent in the print system (s) corresponding to this print area 32 is increased. This can take place in discrete steps of the same size. Alternatively, the increase in the amount of dampening agent can take place as a function of the amount of ink present in the measured area. This amount of ink present on the web 1 in the measured area 36 or 37 affects the intensity of the light reflected by the web 1. The so-called scumming limit is employed as the criteria for determining an optimal amount of dampening agent. In general, that state of a printing process is identified as the scumming limit in which first particles of ink settle in the image-free areas 36 or 37 of the printing plate or the web 1. This scumming limit can be detected by means of measuring techniques in that the reflected light in these image free areas 36 or 37 is only slightly different from the light reflected from the blank web 1 in the center strip 34 of the composite blank strip 33, i.e. of the reference measurement. Starting at this scumming limit, the supplied amount of dampening agent is increased by a small, defined amount, for example by 5% to 10%, so that an optimal supply of dampening agent slightly above the scumming limit is achieved. After each change of the amount of dampening agent which has taken place, a further change in the amount of dampening agent is made only after a defined reaction time, for example after ten cylinder revolutions. As long as the optimal amount of dampening agent has not yet been reached, i.e. as long as there is scum on the web 1 in the blank leading or trailing strips 36 or 37 and the amount of the deposited ink exceeds a selectable set value, a waste shunt is opened, a signal is displayed on the display unit 31, and the affected printed products are removed. With only slight scumming, i.e. after exceeding a selectable second set value, the waste shunt can also remain closed and only a signal can be shown on the display unit 31.

To prevent the application of an excess amount of dampening agent, it is possible to slowly reduce the amount of dampening agent at defined time intervals, for example at fifteen minute intervals, during the continued printing process until ink is deposited in the strips 36 and 37. Subsequently the amount of dampening agent is again increased up to the scumming limit and, starting with the scumming limit, is slightly raised by a small defined amount in order to obtain an optimal amount of dampening agent.

When using a spray dampening system, it is possible to also detect individual scumming zones extending in the circumferential direction and to regulate the amount of dampening agent zone by zone. This can take place, for example, by means of a change in the frequency of the spray pulses of a respective associated spray nozzle. To this end, each zone can have its own detector and a spray nozzle assigned to it.

While a preferred embodiment of a method for regulating dampening agent on a printing plate of a web-fed rotary printing press in accordance with the present invention have been set forth fully and completely hereinabove, it will be apparent to one of skill in the art that a number of changes in, for example the size of each printing unit, the number of printing units, the specific dampening agent used and the like may be made without departing from the true spirit and scope of the present invention which is accordingly to be limited only by the following claims.

What is claimed is:

1. A method for regulating an amount of dampening agent supplied to a printing plate carried by a plate cylinder of a web fed rotary printing press having at least one printing unit including a dampening unit and printing spaced print areas on a web passing through the printing unit including:

positioning an optoelectrical detector adjacent said printed web downstream, in a direction of web travel, of said printing unit;

determining a reference signal received by said detector from said web in a central strip of a composite strip formed between subsequent ones of said print areas of said web with said central strip being blank;

detecting an amount of ink in at least one of leading and trailing blank strips of said composite strip, said leading and trailing strips being defined by said central strip and by said spaced print areas;

providing a measured signal indicating said amount of ink;

comparing said reference signal and said measured signal; and regulating said amount of said dampening agent based on said comparison.

2. The method of claim 1 further including increasing said amount of dampening agent up to a scumming limit if ink is detected in said at least one of said leading and trailing strips; continuing to increase said amount of dampening agent until no such ink is detected; and again increasing said amount of dampening agent above said scumming limit.

3. The method of claim 1 further including reducing said amount of dampening agent supplied at selectable time intervals; detecting the presence of ink in said at least one of said leading and trailing strips; increasing said amount of dampening fluid up to a scumming limit at which no ink is again present in said at least one of said leading and trailing strips; and slightly increasing said amount of dampening agent above said scumming limit.

4. The method of claim 2 including increasing said amount of dampening agent at said scumming limit by approximately 5% to 10%.

5. The method of claim 3 including increasing said amount of dampening agent at said scumming limit by approximately 5% to 10%.

6. The method of claim 1 further including separating said plate cylinder into a plurality of circumferentially extending zones and regulating said amount of dampening agent in each of said zones.

7. The method of claim 6 further including providing said dampening unit as a spray dampening system and having a plurality of spray nozzles and assigning at least one of said spray nozzles to each of said zones.

8. The method of claim 6 wherein at least one of said detectors is assigned to each zone.

9. The method of claim 1 further including illuminating said web using an illuminating device, and sensing light reflected off said web by said detector at times determined by trigger signals supplied to said detector.

10. The method of claim 1 further including providing more than one printing unit in said printing press; positioning a single measuring bar having said detector adjacent said printed web; and using said single measuring bar to detect said amounts of ink from said several printing units.

11. The method of claim 9 further including providing optical filters; separating said light reflected off said web into individual spectral ranges; and supplying said spectral ranges to said detector.

12. The method of claim 2 further including increasing said amount of dampening agent up to said scumming limit as a function of an amount of ink deposited on said web.

* * * * *